United States Patent [19]

Volk et al.

[11] Patent Number: 4,915,287

[45] Date of Patent: Apr. 10, 1990

[54] INTELLIGENTLY IMAGED ENVELOPES WITH INTELLIGENTLY IMAGED INTEGRAL TEAR-OFF FLAPS

[75] Inventors: Steven Volk, Birmingham, Mich.; Kenneth R. Greulich, Youngstown, N.Y.

[73] Assignee: Moore Business Forms, Inc., Grand Island, N.Y.

[21] Appl. No.: 266,766

[22] Filed: Nov. 3, 1988

[51] Int. Cl.[4] ..... B65D 27/00

[52] U.S. Cl. ..... 229/70; 229/73; 206/449; 283/48.1; 283/51; 283/52

[58] Field of Search ..... 229/70, 73, 72; 206/449; 282/9 A, 9 B, 25, 3 B, DIG. 1; 283/51, 52, 52.1, 48.1

[56] References Cited

U.S. PATENT DOCUMENTS

| | | | |
|---|---|---|---|
| 460,472 | 9/1891 | Hitt | 206/554 |
| 681,659 | 8/1901 | Sallade | 229/72 |
| 806,200 | 12/1905 | Sims | 229/72 |
| 837,228 | 11/1906 | Jackson | 229/72 |
| 1,019,275 | 3/1912 | Press | 229/72 |
| 1,310,188 | 7/1919 | Hogan . | |
| 1,405,002 | 1/1922 | Rhodes | 229/73 X |
| 1,449,999 | 3/1923 | Innes | 283/52 |
| 1,600,995 | 3/1926 | Rice | 283/52 |
| 1,951,955 | 3/1934 | Wilde | 229/72 |
| 1,980,241 | 11/1934 | Wilson et al. | 229/72 |
| 2,132,227 | 10/1938 | Winkler et al. . | |
| 2,147,541 | 2/1939 | Oberender . | |
| 2,166,439 | 7/1939 | Johnson | 229/73 X |
| 2,184,362 | 12/1939 | Sauerman . | |
| 2,289,460 | 7/1942 | Sacks | 229/73 |
| 2,402,821 | 6/1946 | Kosteling | 229/73 |
| 2,673,497 | 3/1954 | Heitmann . | |
| 2,815,620 | 12/1957 | Prodigo . | |
| 2,840,296 | 6/1958 | Fromm | 229/70 |
| 2,910,222 | 10/1959 | Bermingham, Jr. et al. | 229/73 |
| 2,964,233 | 12/1960 | McFarland | 229/73 |
| 3,113,716 | 12/1963 | Howard | 229/73 |
| 3,261,623 | 7/1966 | Kiedrowski | 229/73 X |
| 3,350,988 | 11/1967 | Schultz . | |
| 3,507,519 | 4/1970 | McNabb . | |
| 3,552,282 | 1/1971 | Wilson . | |
| 3,602,114 | 8/1971 | Peters . | |
| 3,652,007 | 3/1972 | MacDougall | 229/73 |
| 3,701,468 | 10/1972 | Steinhauser | 229/70 |
| 3,853,041 | 12/1974 | Lynas . | |
| 3,869,080 | 3/1975 | Anderson et al. | 229/71 |
| 3,894,905 | 7/1975 | Ehlscheid . | |
| 3,908,892 | 9/1975 | Pelzer | 229/73 |
| 3,911,818 | 10/1975 | Macilvaine . | |
| 3,977,597 | 8/1976 | Wise et al. | 229/73 |
| 3,980,006 | 9/1976 | Welch . | |
| 4,031,818 | 6/1977 | Kehoe . | |
| 4,044,942 | 8/1977 | Sherwood | 229/73 |
| 4,067,171 | 1/1978 | Herbert et al. . | |

(List continued on next page.)

FOREIGN PATENT DOCUMENTS

| | | | |
|---|---|---|---|
| 2117319 | 10/1983 | United Kingdom | 229/73 |

OTHER PUBLICATIONS

"Rotary Reel-Fed Envelope Machine CF 72 for Side--Seam Envelopes", Smithe-Rema Maschinenfabrik GmbH & Co. KG.

*Primary Examiner*—Stephen Marcus
*Assistant Examiner*—K. M. Stemann
*Attorney, Agent, or Firm*—Nixon & Vanderhye

[57] ABSTRACT

Disclosed is a set of communications documents, each of which includes an integrated envelope and return coupon with intelligently imaged variable and non-variable information. Alpha/numeric characters are provided on the document and scannable by character recognition machines. The envelopes may be plow- or buckle-folded and each has an attached coupon and flap whereby the coupon can be removed from the envelope, inserted into the envelope and the flap sealed to the envelope. Each document is arranged in a set or collection of documents in serial order and packaged such that orderly use of the documents can be effected, with each document so used being unique unto itself.

11 Claims, 6 Drawing Sheets

U.S. PATENT DOCUMENTS

| | | | |
|---|---|---|---|
| 4,091,987 | 5/1978 | Cone . | |
| 4,093,117 | 6/1978 | Morse | 229/70 |
| 4,332,193 | 6/1982 | Noyes . | |
| 4,411,643 | 10/1983 | Higginson . | |
| 4,437,852 | 3/1984 | Volk, Jr. et al. . | |
| 4,440,341 | 4/1984 | Pennock . | |
| 4,445,635 | 5/1984 | Barr | 229/73 |
| 4,454,980 | 6/1984 | Poehler . | |
| 4,475,747 | 10/1984 | Ashby . | |
| 4,559,755 | 12/1985 | Romangnoli . | |
| 4,648,540 | 3/1987 | Steidel . | |
| 4,651,920 | 3/1987 | Stenner | 229/70 |
| 4,668,211 | 5/1987 | Lubotta et al. . | |
| 4,688,715 | 8/1987 | Barr . | |
| 4,705,298 | 11/1987 | Van Malderghem et al. . | |
| 4,706,878 | 11/1987 | Lubotta et al. | 229/73 |
| 4,730,767 | 3/1988 | Gendron | 229/70 X |
| 4,756,468 | 7/1988 | Jenkins | 229/73 |

INTELLIGENTLY IMAGED ENVELOPES WITH INTELLIGENTLY IMAGED INTEGRAL TEAR-OFF FLAPS

BACKGROUND AND SUMMARY OF THE INVENTION

The present invention relates to a communications document system including an integrated envelope and return coupon having information intelligently imaged thereon on-line during the document-forming process and more particularly relates to an integrated envelope and return coupon imaged simultaneously with variable, usually sequential, and non-variable information during an on-line manufacturing process and forming part of a sequentially usable set of communications documents. The present invention also relates to an integrated envelope and return coupon imaged to provide machine readable characters scannable, i.e., by optical or magnetic ink character recognition machines.

With the use of computers and the advent of relatively high-speed, intelligent imaging processes, such as computer-generated Xerography, laser and ion deposition printing, it has now become possible to generate and simultaneously image both variable and non-variable information on discrete documents such that each document may be unique unto itself, e.g., with personalized or individualized information, as well as have fixed or non-variable information common to other documents. For example, personalized letters may be continuously intelligently imaged under the control of a computer with parts of the letter being common to every other letter.

A further example of products employing both variable and non-variable intelligently imaged information is payment or coupon books which are frequently employed where periodic payments are necessary. Such payment books typically comprise a series of coupons intelligently imaged with both variable and non-variable information, conventionally using successive printing processes, and wherein the individual coupons are secured one to the other to form a coupon booklet. The booklet usually includes additional information documents, such as change of address forms, tax information, addressee labels for use when effecting payment, etc. Thus, a user conventionally tears off the coupon from the book, applies the address label to a totally separate, non-individualized standard envelope, inserts the coupon into the envelope, as well as a payment check, and mails the envelope to the addressee. Each coupon is individualized with payment information which varies from coupon to coupon. For example, the date and amount due may vary from coupon to coupon and such information would be variably imaged on the coupon.

However, substantial difficulty has been encountered in adopting systems such as these for intelligently imaging envelopes with such information because of the complexity of the envelope-forming machines and the multiplicity of forming operations necessary to not only form the envelope but also to locate the intelligently imaged information in the appropriate place on the envelope. Intelligently imaged mailing envelopes, of course, have been provided in the past. For example, U.S. Pat. No. 4,668,211 to Lubotta et al. discloses an intelligently imaged "self-mailer" using a laser printer capable of imaging any desired information on the mailers and also capable of changing the imaged information from one mailer to another. Pre-formed, pre-glued envelope blanks, including integrally formed detachable inserts are fed one by one through a laser printer in such a manner that all the surfaces of the mailer to bear information are on the same side. The printer prints variable, intelligently imaged information, e.g., address and return address, individual account number, individualized messages, on the mailer surfaces. The mailer is separated after printing, glued, folded closed, and mailed. This technique, however, requires substantial processing, particularly in that the envelopes must be pre-formed by an envelope maker and then subsequently transported by hand or conveyor to a laser printer. The printer, of course, requires a special feed mechanism for handling envelopes. To applicants' knowledge, none of the prior art envelope-forming and printing processes contemporaneously print variable and non-variable information on an envelope blank with subsequent folding and formation of the envelope in a continuous on-line process. Moreover, to applicants' knowledge, none of these prior intelligently imaged envelopes locate optically or magnetically scannable variable information in the context of the formation of an envelope. Exactitude with respect to the necessary location of the optically or magnetically scannable characters is necessary and consistency and accuracy of the imaging of those characters vis-a-vis the machine cutlines has been a problem.

According to the present invention, there is provided intelligently imaged integrated envelopes with return coupons or tear-off flaps which may be received within the envelopes for purposes of mailing to a predesignated addressee. Thus, each envelope in a series of envelopes is simultaneously intelligently imaged with both variable and non-variable information such that the final product constitutes a series or set of envelopes with integral coupons or flaps related one to the other by the particular variable information intelligently imaged thereon. For example, such related information may include serial information, such as date of payment, amount of payment, the amount of the remaining balance due, the number of that particular payment or remaining payments, etc. The coupon may also be imaged with information which is non-variable among the documents of the set or collection thereof, e.g., the name and address of the recipient or payee, the account number and other information, such as formatting information. Thus, by employing both variable and non-variable information on each document and assembling the documents serially to form a set or collection of documents, and retaining them in assembled condition for use, each individual integrated envelope and return coupon may be used in proper sequence with the appropriate information on each document.

A further advantage of the present invention is that by imaging both non-variable and variable information simultaneously on the envelope during its formation, machine-readable characters may be located as desired to meet the requirements of the customer's scanning machines. Thus, whether the scannable information be optically readable or of the type readable by magnetic ink character recognition machines, it may be accurately located relative to the edge of the coupon and/or the envelope to be amenable to machine reading.

In a preferred embodiment of the present invention, there is provided an integrated envelope and return coupon mailing system comprising an elongated paper sheet having first and second foldlines spaced longitudinally one from the other to define first, second and third panels, the first and second panels being foldable relative to one another about the first foldline such that the first panel overlies the second panel. Non-variable and/or variable information is imaged on at least one of the first and second panels and on the third panel, all such printed information being imaged on the same side of the sheet. Means are provided for adhesively securing the first and second panels one to the other along longitudinally extending margins thereof when the first panel overlies the second panel such that the first and second panels define an envelope. Additional means define a coupon in the third panel and include a line of transversely extending perforations for separating the coupon from the sheet whereby the coupon may be received in the envelope, the variable information being carried by the coupon. The third panel is foldable about the second foldline to overlie the first panel, the first and third panels being free of any means for securing such panels one to the other when the third panel overlies the first panel. One of the second and third panels defines a flap foldable to overlie the first panel, the flap carrying a transversely extending line of adhesive for sealing the flap and the first panel one to the other to seal the envelope, and being defined in part by the line of perforations.

In a still further preferred embodiment of the present invention, there is provided a set of communication documents, comprising a plurality of integrated envelope and return coupon documents, each of the documents comprising an elongated paper sheet having first and second foldlines spaced longitudinally one from the other to define first, second and third panels, the first and second panels being foldable relative to one another about the first foldline such that the first panel overlies the second panel. First information is imaged on at least one of the first and second panels and on the third panel and second information is imaged at least on the third panel. Means are provided for adhesively securing the first and second panels one to the other along longitudinally extending margins thereof when the first panel overlies the second panel such that the first and second panels define an envelope. Additional means define a coupon in the third panel and include a line of transversely extending perforations for separating the coupon from the sheet whereby the coupon may be received in the envelope, the second information being imaged on the coupon and the third panel being foldable about the second foldline to overlie the first panel. One of the second and third panels defines a flap foldable to overlie the first panel, the flap carrying a transversely extending line of adhesive for sealing the flap and the first panel one to the other to seal the envelope, the flap being defined in part by the line of perforations. The documents are provided in a predetermined number thereof and juxtaposed in generally parallel relation one to the other to define a set of documents, the first information being non-variable in informational content and location on each of the documents and the second information being variable in informational content from document to document. Retaining means juxtapose the documents relative to one another in the set thereof, thus providing a convenient means of delivering the documents to the payor via mail or other means.

Accordingly, it is a primary object of the present invention to provide novel and improved communications documents including an integrated intelligently imaged envelope and return coupon or tear-off flap which may be provided in a serially arranged set or collection of such communications documents whereby a user may readily and without use of ancillary materials forward the appropriate document to a recipient and wherein the forwarded document has accurately located variably imaged characters readable by scanning character recognition machines.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
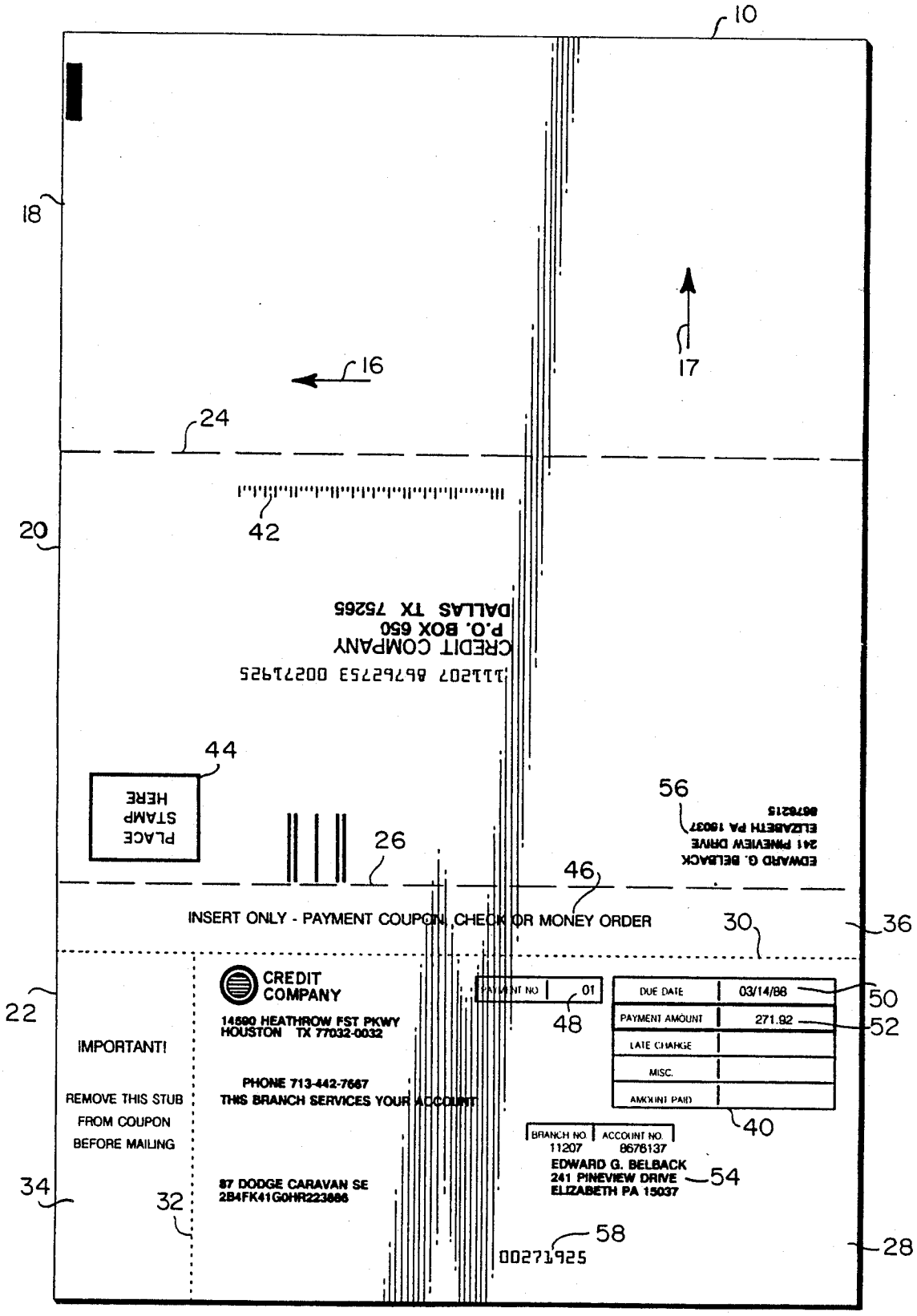
FIG. 1 is a plan view of an envelope blank with variable and non-variable information intelligently imaged thereon for use in forming, as part of a communications document system, an integrated envelope and coupon or tear-off flap according to the present invention.

Referring now to the drawing figures, particularly to FIG. 1, there is illustrated a flat paper envelope blank 10. Envelope blank 10 is intelligently imaged with variable and non-variable information and subsequently folded in a continuous on-line process, which is the subject of the above-identified companion application, into an envelope and a coupon or tear-off flap. Envelope blank 10, in the continuous on-line envelope formation process is fed in the direction of the arrow 16 and, in a conventional manner, plow-folded to form the envelope or in the direction 17 and, likewise in a conventional manner, buckle-folded to form the envelope. Particularly, blank 10 includes first, second and third panels 18, 20 and 22, respectively. The first and second panels are spaced one from the other by a foldline 24 and the second and third panels are separated one from the other by a foldline 26, foldlines 24 and 26 being spaced one from the other.

The third panel 22 is provided with a detachable coupon 28 which is separable from the remaining portions of panel 22 along a longitudinally extending line of perforations 30. For reasons which will become apparent, a line of perforations 32 are also provided adjacent one end of panel 22 and which perforations lie at right angles to the line of perforations 30. Thus, the coupon 28 may be removed from panel 22 by tearing along perforation line 30. As illustrated, the perforation line 30 extends the full length of the panel 22 and thus, upon removal of coupon 28, the remaining stub 34 may be separated from coupon 28 by tearing along a perforation line 32 and discarded.

Figure 2:
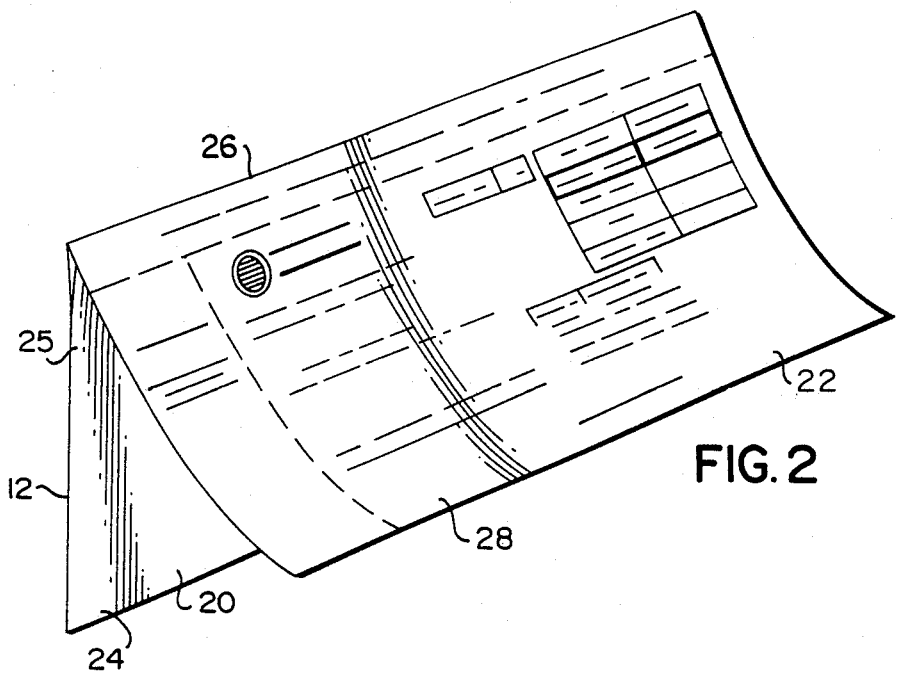
FIG. 2 is a perspective view of the blank of FIG. 1 folded and adhesively secured in envelope form with the attached coupon.

Importantly, and in accordance with the present invention, non-variable and variable information is simultaneously intelligently imaged on the blank 10 prior to folding the blank into its integrated envelope and coupon configuration as illustrated in FIG. 2. For purposes of this application, non-variable information means information intelligently imaged on the blank simultaneously with the variable information, for example, by a laser printer under computer control, and which non-variable information does not vary from blank to blank upon the formation of a predetermined number of integrated envelope and coupon documents into a set or collection of communication documents. For example, the blank 10 illustrated in FIG. 1 is imaged for the specific purpose of providing a collection of documents for making car payments on a monthly basis. Therefore, such non-variable information in this instance and within this particular collection of documents may include the identity of the automobile purchased, its identification number, the identity of the payee or the recipient, in the illustrated instance, the Credit Company, together with its address and telephone number, as well as all formatting such as the boxes and identifying indicia for such boxes indicated at 40. Additional non-variable information may include postal bar codes 42, the area 44 which defines the location for placement of the postal stamp, instructions for use of the form or for complying with the procedures for payment of the amount due, for example, as illustrated at 46, and the like.

As used herein, the term "variable information" means information intelligently imaged on bank 10, e.g., by a computer-controlled laser printer, simultaneously with the non-variable information but which variable information varies from blank to blank within the set or collection of documents being imaged. Thus, for example, in the set of documents, one of which is illustrated in FIG. 1, the variable information may include, by way of example, the payment number 48, the actual date due 50 and the amount of the payment 52, if such payment varies from month to month. It will be appreciated that the non-variable information in one set or collection of documents may be different from the non-variable information of another set or collection of documents. For example, in the illustrated blank, the name and address of the payor, illustrated at 54, both on the coupon 28 and as a return addressee at 56 in the second panel 20, would be altered from set to set depending on the identity of the payor. Consequently, it will be appreciated that with computer-driven intelligent imaging, both the variable and non-variable information, as defined above, are simultaneously imaged on the blank and that the distinction between variable and non-variable information is with respect to the set or collection of documents.

Additionally, variable or non-variable information is preferably located on the blank 10 in the form of alpha/-numeric or other human or machine-readable characters. For example, the account number or other information indicated at 58 may be provided in machine readable characters, e.g., optically readable (including bar codes), or in magnetic ink such that the characters imaged on the form may be machine-read, e.g., optically or magnetically scanned. By correlating the feed of the blank with the computer-generated information, the location of the scannable characters, on the return coupon and/or the envelope, is such as to render them machine-readable within the window defined by the character reading machine.

Figure 1A:
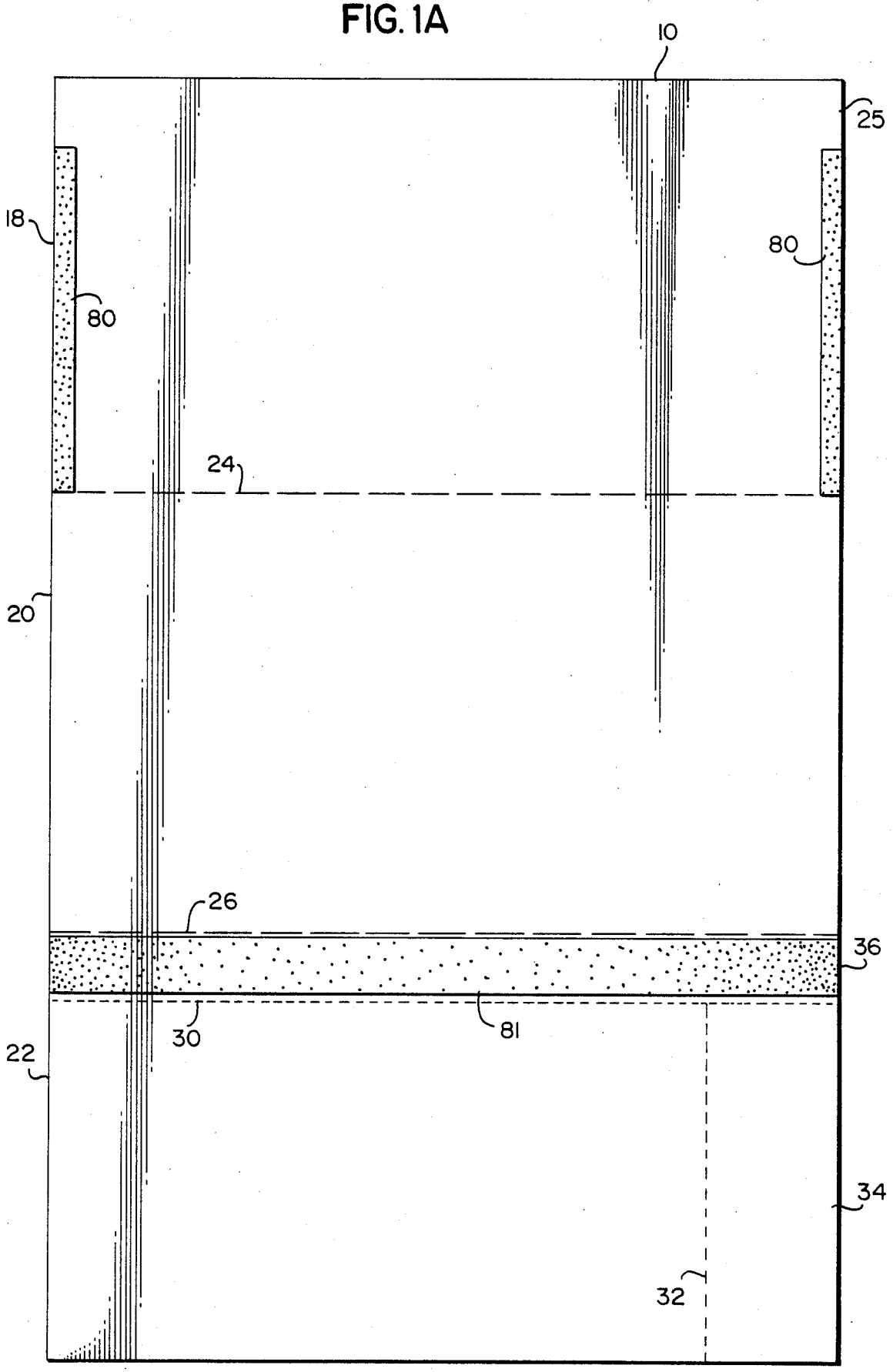
FIG. 1A is a plan view of the reverse side of the envelope blank illustrated in FIG. 1.
Figure 3:
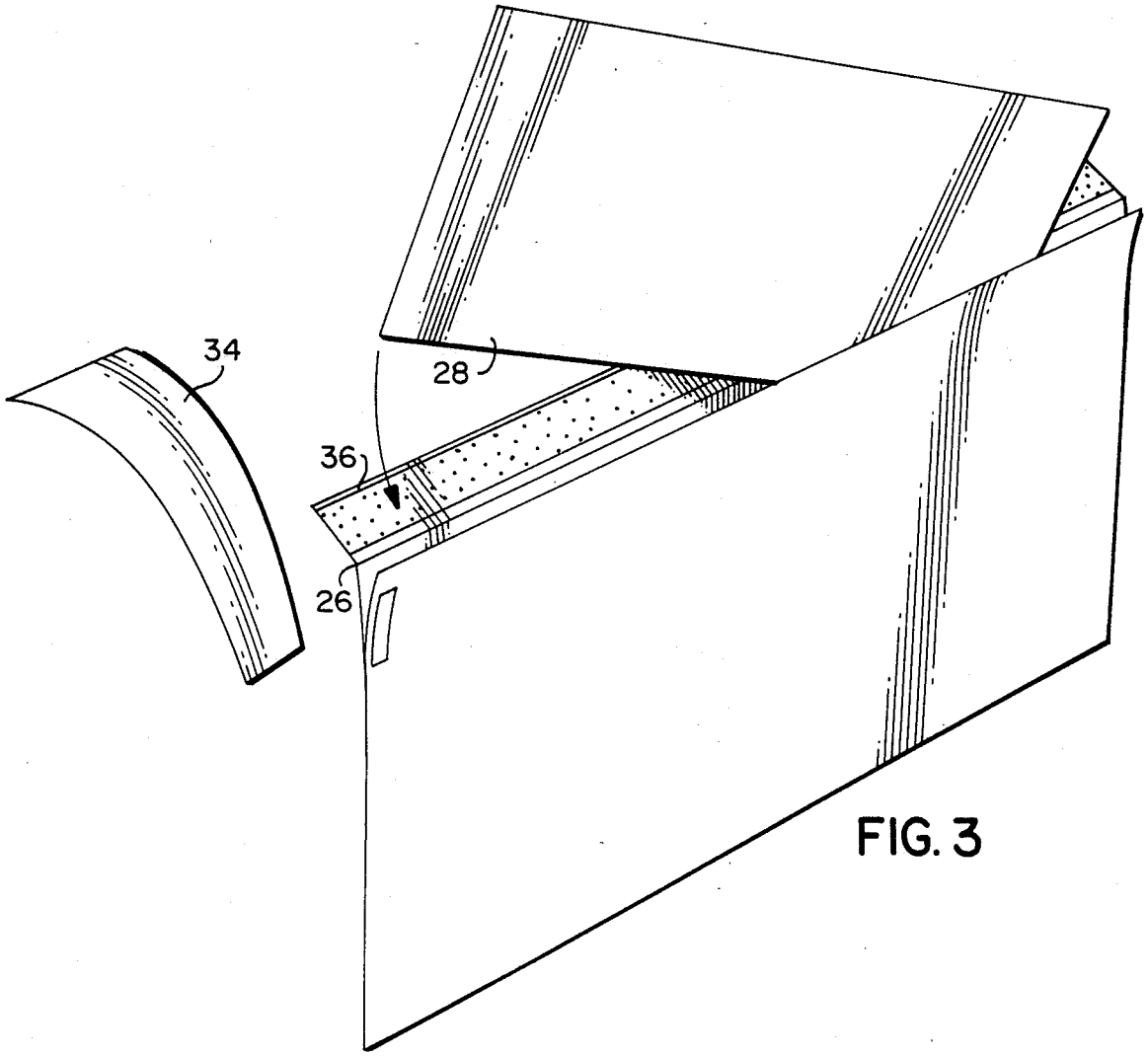
FIG. 3 is a perspective view illustrating the manner of use of the envelope and coupon of FIG. 2.

Referring now particularly to FIG. 1A, 2 and 3, FIG. 1A illustrates the back side of blank 10 whereon lines of adhesive 80 are disposed along the backside of the margins of one or the other of panels 18 and 20 and along their end edges such that, when the panels 18 and 20 are folded about foldline 24, the lines of adhesive secure the end edges of those panels one to the other, as illustrated in FIG. 2, to form envelopes 12 and a tear-off flap or coupon 28. The lines of adhesive preferably extend between the end edges of the first and second panels from the foldline 24 toward the opposite edges thereof but terminate short of such opposite edges. In this manner, a flap 25 is formed along panel 18 along the upper edge of the envelope opening which can be displaced outwardly to facilitate opening of the envelope by automatic mail opening machines. Also as illustrated in FIG. 2, panel 22 may be folded about foldline 26 to overlie the first panel 18. Third panel 22 is, however, not secured to the underlying first panel 18 for reasons which will become apparent from the ensuing description. It will be appreciated that in the completed integrated envelope and coupon hereof, all three panels 18, 20 and 22 overlie and lie parallel to one another.

A rewettable adhesive 81 is provided between foldline 26 and the line of perforations 30 along the underside of blank 10, i.e., FIG. 1A. Consequently, the portion of the panel 22 between foldline 26 and the line of perforations 30 forms an envelope flap 36. Thus, as illustrated in FIG. 3, once coupon 28 has been removed and stub 34 discarded, coupon 28 may be disposed in envelope 12 and flap 36 folded about foldline 26 for sealing the envelope.

Figure 4A:
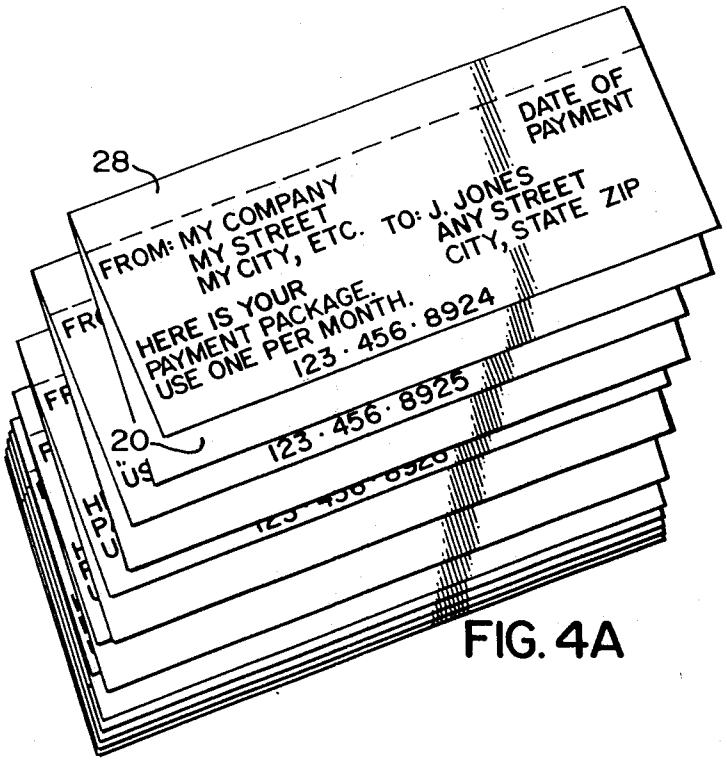
FIG. 4A is a perspective view illustrating a collection or set of intelligently imaged documents according to the present invention.
Figure 4:
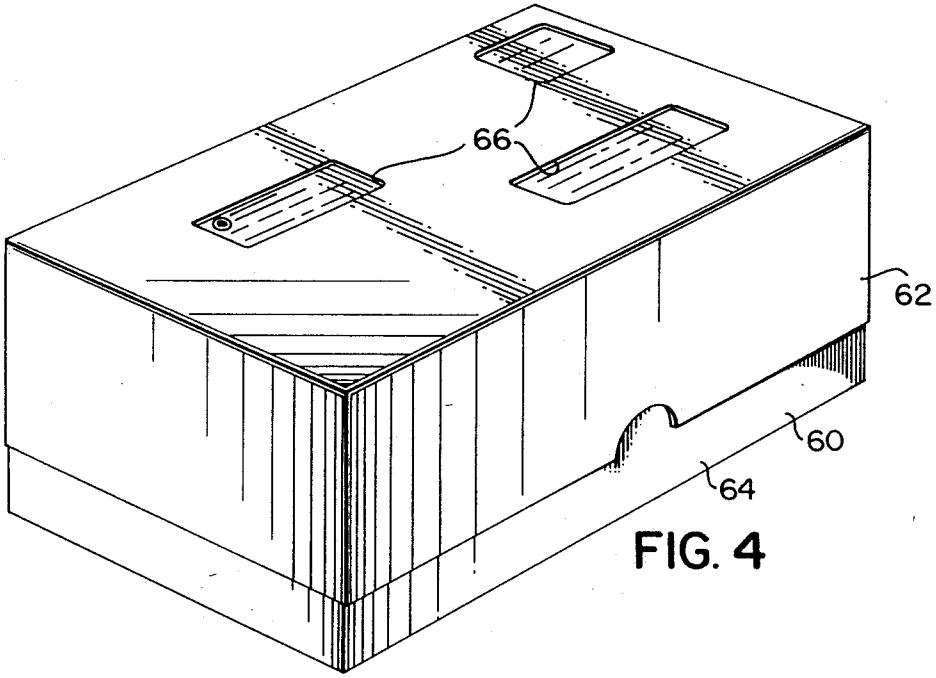
FIG. 4 illustrates a box for containing a set or collection of the communication documents and which documents are related one to the other by the variable information intelligently imaged on the document.

In the example of the present invention given above, the set or collection of documents as illustrated in FIG. 4A, would be collated such that they are juxtaposed in serial or sequential form in accordance with the variable information imaged on the documents and hence packaged in that order. For example, in FIG. 4, there is illustrated a box or container 60 having a top 62 and a base 64 for receiving the set or collection of sequentially arranged documents illustrated in FIG. 4A. Openings 66 are variously provided in the upper surface of the top 62 of the box 60 such that certain information may be visible, and hence readable, through the openings. For example, in the illustrated form, the name and address of both the payor and payee would appear in the two large windows illustrated in FIG. 4, while the date of payment might appear through the third window in the arrangement of FIG. 4. Thus, the order of the communications documents in the stack thereof illustrated in the box would correspond to the desired order of use of the documents.

Figure 5:
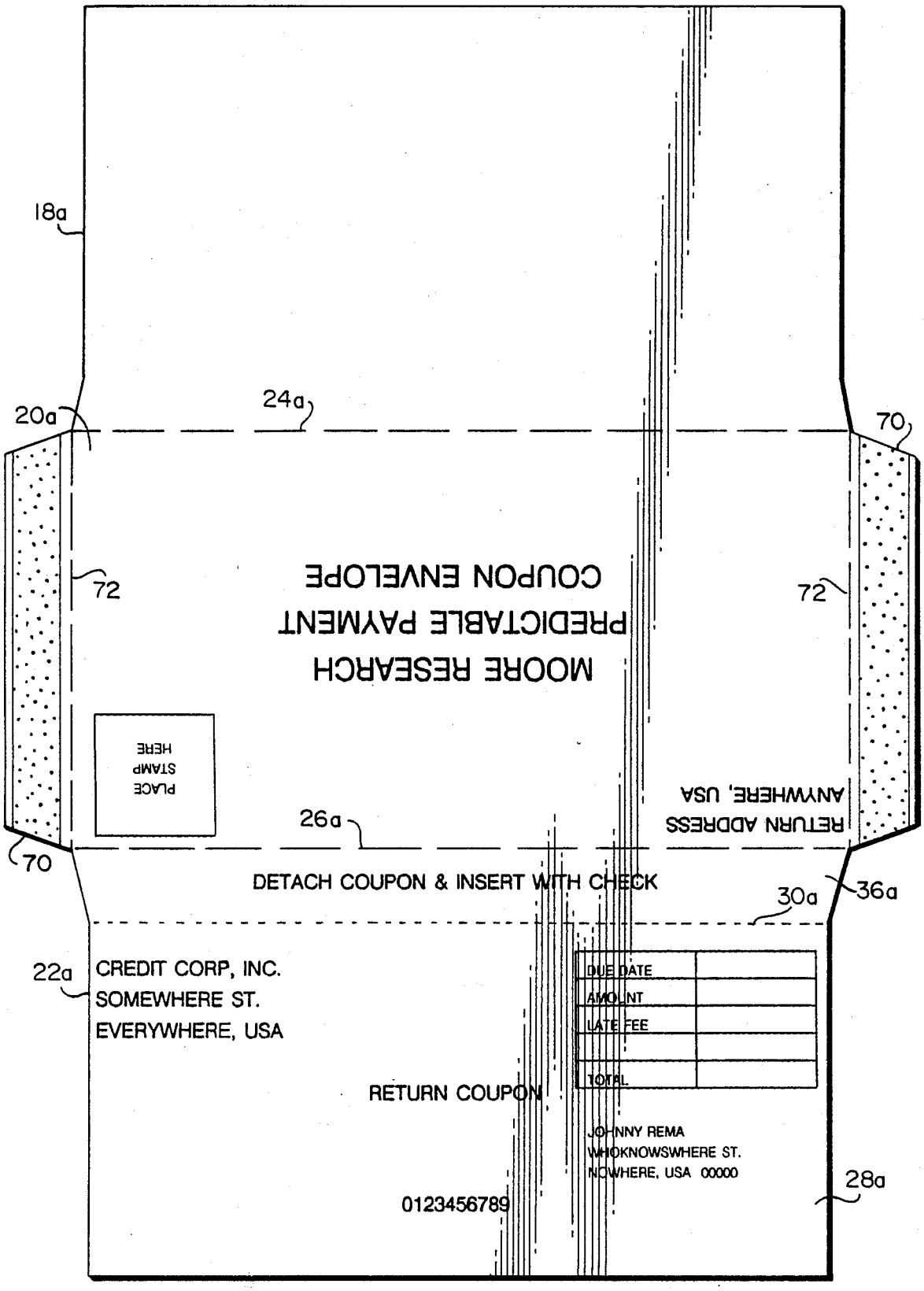
FIG. 5 is a view similar to FIG. 1 illustrating a further embodiment of integrated envelope and coupon of the present invention.
Figure 6:
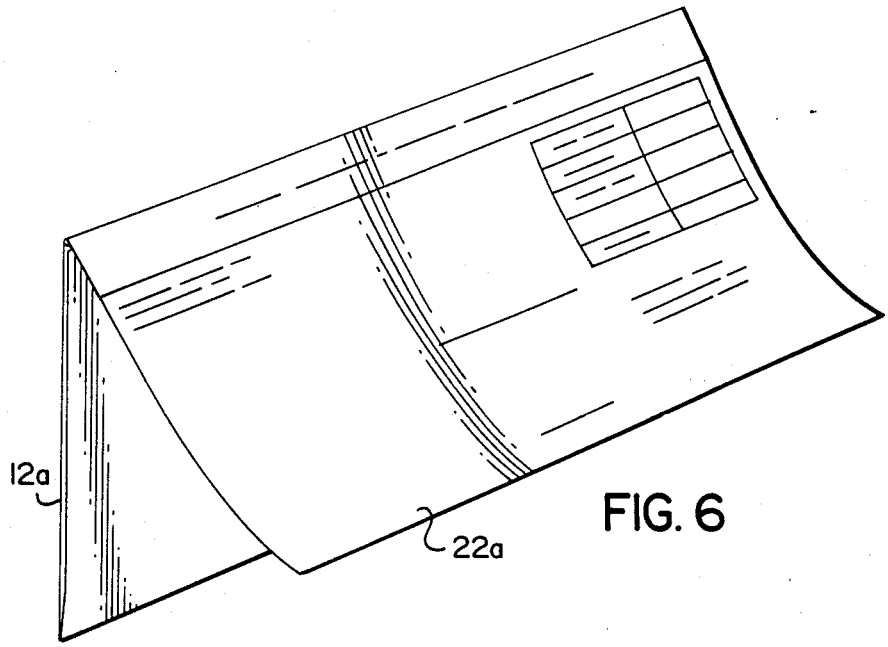
FIG. 6 is a perspective view of the envelope and coupon illustrated in FIG. 5.
Figure 7:
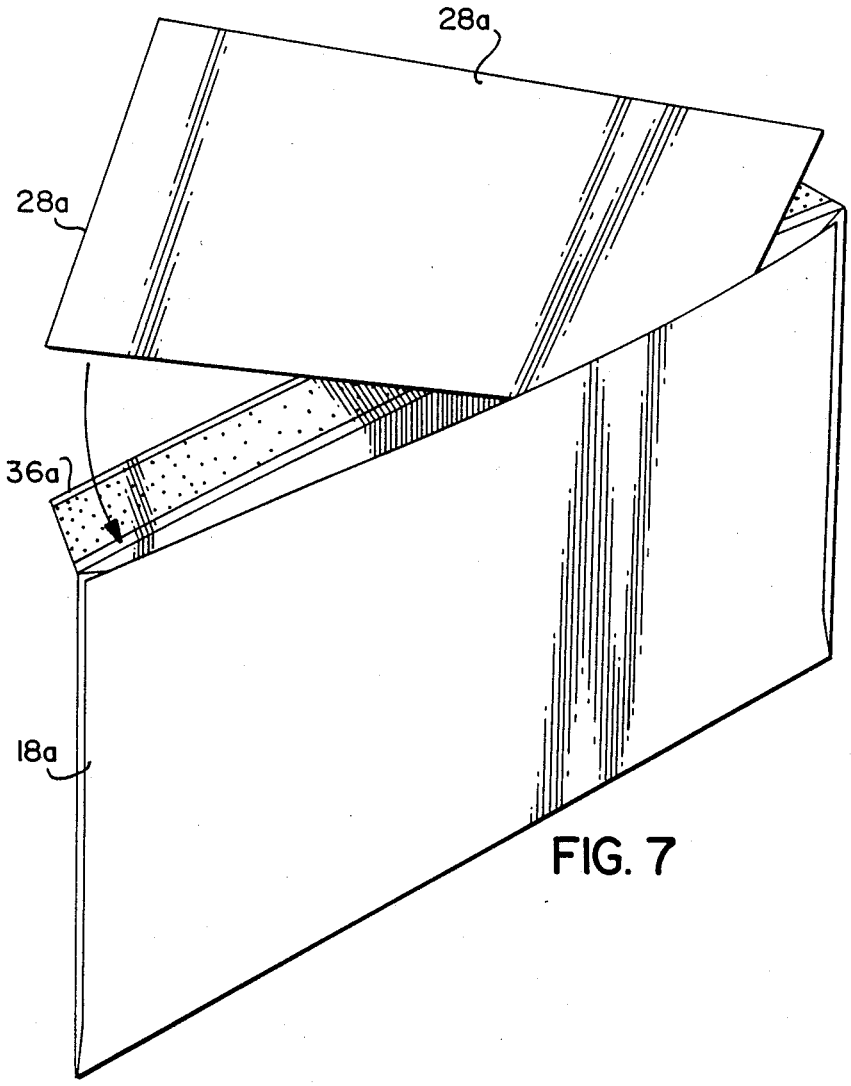
FIG. 7 illustrates the manner of use of the envelope and coupon illustrated in FIG. 6.

Turning now to the embodiment hereof illustrated in FIGS. 5–7, like parts as in the embodiment of FIGS. 1–4 are denoted by like reference numerals, succeeded by the suffix "a". The envelope of FIGS. 5–7 is intelligently imaged, cut, folded and then shingled out. In this form, the end edges of the first and third panels **18*a*** and 22*a* are die-cut to slightly shorten the length of the panels. The second panel 20*a* has a pair of flaps 70 which project from its opposite ends. In this conventional type envelope configuration, the flaps 70 have adhesive applied thereto and are foldable about foldlines 72 transverse to foldline 24*a* to overlie second panel 20*a*. When the flaps 70 are folded about foldlines 72, it will be appreciated that the body of envelope 12*a* may be formed. Panel 22*a* has similar type variable and non-variable information intelligently imaged thereon as in the previous embodiment and the envelope face likewise includes intelligently imaged information. In this form, the coupon 28*a* has a length slightly shorter than the length of the envelope and, when detached along perforation line 30*a*, may be disposed within envelope 12*a*, as illustrated in FIG. 7. As in the previous embodiment, the flap 36*a* between the foldline 26*a* and perforation line 30*a* constitutes a sealing flap for the envelope. Adhesive, preferably rewettable, is applied to the underside of the flap 36*a* so that the envelope may be sealed.

This envelope may likewise be packaged, for example, in a box or plastic wrapped, or otherwise packaged similarly as in the previous embodiment to provide an orderly set or collection of communications documents.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A set of communication documents, comprising:

a plurality of integrated envelope and return coupon documents;

each of said documents comprising an elongated paper sheet having first and second foldlines spaced longitudinally one from the other to define first, second and third panels, said first and second panels being foldable relative to one another about said first foldline such that said first panel overlies said second panel;

means for adhesively securing said first and second panels one to the other along longitudinally extending margins thereof when said first panel overlies said second panel such that said first and second panels define an envelope;

means defining a coupon in said third panel and including a line of transversely extending perforations for separating said coupon from said sheet whereby said coupon may be received in said envelope:

said third panel being foldable about said second foldline to overlie said first panel;

first and second information substantially simultaneously imaged on at least one side of one of said first, second and third panels and at least on said second prior to folding said sheet about said first and second foldlines;

one of said second and third panels defining a flap foldable to overlie said first panel, said flap carrying a transversely extending line of adhesive for sealing the flap and said first panel one to the other to seal the envelope, said flap being defined in part by said line of perforations;

said documents being provided in a predetermined number thereof and juxtaposed in generally parallel relation one to the other to define a set of documents, said first information being non-variable in informational content and location on each of said documents and said second information being variable in informational content from document to document within said set; and means for retaining said documents juxtaposed relative to one another in said set thereof.

2. A set according to claim 1 wherein said first and third panels are free of any means for securing such panels one to the other when said third panel overlies said first panel.

3. A set according to claim 1 wherein said documents are uniformly juxtaposed relative to one another with said third panel on one document lying adjacent the second panel of the next adjacent document.

4. A set according to claim 1 wherein said second information is part of a progression of orderly sequential information on said documents, said documents being juxtaposed in said set thereof in sequential order of the progression of said second information.

5. A set according to claim 4 wherein said retaining means includes a box having a base with upstanding sides and a top and means opening through said top for viewing the first and second information on one of said second and third panels, said documents being removable from said box in sequence.

6. A system according to claim 1 wherein said first and second information is imaged for scanning by optical scanning machines to produce intelligible information.

7. A system according to claim 1 wherein said first and second information is imaged for scanning by magnetic ink character recognition machines to provide intelligible information.

8. A system according to claim 1 wherein said coupon has a transverse width less than the width of said sheet.

9. A system according to claim 8 wherein said third panel includes a line of perforations extending generally parallel to the longitudinal extent of said sheet and intersecting said transversely extending lines of perforations whereby said lines of perforations define two sides of said coupon.

10. A system according to claim 1 wherein said adhesive securing means along the margins of said first and second panels extends from said first foldline short of the ends of said first and second panels remote from said first foldline.

11. A system according to claim 1 wherein said second panel has flaps at its opposite ends foldable about foldlines normal to the first and second foldlines to overlie said second panel, the end margins of said first and third panels being inset from the flap foldlines, said adhesive securing means securing said flaps and said first panel one to the other when said flaps are folded to overlie said second panel.

* * * * *